US006357939B1

(12) United States Patent
Baron

(10) Patent No.: US 6,357,939 B1
(45) Date of Patent: Mar. 19, 2002

(54) METHOD OF AND APPARATUS FOR HANDHELD PRINTING OF IMAGES ON A MEDIA

(75) Inventor: John M. Baron, Longmont, CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/776,292

(22) Filed: Feb. 2, 2001

(51) Int. Cl.[7] ..... B41J 3/36

(52) U.S. Cl. ..... 400/88; 400/76; 400/70; 400/61

(58) Field of Search ..... 400/88, 76, 70, 400/61

(56) References Cited

U.S. PATENT DOCUMENTS

| | | | | |
|---|---|---|---|---|
| 5,306,908 A | | 4/1994 | McConica et al. | 250/234 |
| 5,381,020 A | | 1/1995 | Kochis et al. | 250/566 |
| 5,552,597 A | | 9/1996 | McConica | 250/234 |
| 5,586,212 A | | 12/1996 | McConica et al. | 385/146 |
| 5,644,139 A | | 7/1997 | Allen et al. | 250/557 |
| 5,727,890 A | | 3/1998 | Stodder et al. | 400/624 |
| 5,825,995 A | * | 10/1998 | Wiklof et al. | 395/117 |
| 5,927,872 A | * | 7/1999 | Yamada | 400/88 |
| 6,002,124 A | | 12/1999 | Bohn et al. | 250/208.1 |
| 6,005,681 A | | 12/1999 | Pollard | 358/473 |
| 6,043,503 A | | 3/2000 | Dow et al. | 250/566 |
| 6,160,642 A | | 12/2000 | Mui et al. | 358/498 |

* cited by examiner

*Primary Examiner*—John S. Hilten
*Assistant Examiner*—Charles H. Nolan, Jr.

(57) ABSTRACT

The present invention includes a device for a method of printing images with a handheld printing device. The handheld printing device includes a navigation sensor, a controller to correlate image information and navigational information and a printhead to print the image on a printable object or media. The method of printing with a handheld printing device includes moving the handheld printing device in a series of continuous motions in which the handheld printing device determines its position and prints the portion of the image appropriate for its current position. The handheld printing device can be combined with a handheld scanning device to enable a user to scan and print with a handheld device.

20 Claims, 7 Drawing Sheets

METHOD OF AND APPARATUS FOR HANDHELD PRINTING OF IMAGES ON A MEDIA

TECHNICAL FIELD

The present invention relates generally to handheld printing devices and more specifically to handheld printing devices having "navigation" systems for determining the position of the handheld printing device with respect to the printable object.

BACKGROUND

Handheld or portable optical scanners are well known in the prior art and are designed to be moved by hand across the object or document being scanned. The handheld scanner may store the scanned image within its own memory or may be connected directly to a separate computer by a data cable which is used to store the scanned image. For example, U.S. Pat. No. 5,381,020 of Kochis, et al., for "Hand-held Optical Scanner With Onboard Battery Recharging Assembly" discloses a hand-held optical scanner which comprises a hand-displaceable scanner housing; scanner electrical components mounted within the housing for performing scanner operating functions; a battery disposed in the housing and electrically connected to the electrical components; a generator disposed in the housing and operatively associated with the battery; and a roller assembly mounted in the housing and drivingly linked to the generator. U.S. Pat. No. 5,306,908 of McConica, et al., for "Manually Operated Hand-held Optical Scanner With Tactile Speed Control Assembly" describes a hand-held optical scanner comprising an optical sensor for generating a data signal representative of a scanned object; a housing for hand-displaceably supporting the optical sensor; a roller mounted on the housing for enabling rolling displacement of the housing over a scanned object in a predetermined scan direction; a displacement sensing device for sensing the angular displacement of the roller and generating a displacement signal representative thereof; a motor drivingly linked to the roller for applying a driving torque thereto; a controller for actuating the motor responsive to the displacement signal for angularly accelerating and decelerating the roller for urging an operator to hand displace the housing across a scanned object within a predetermined speed range which is optimal for scanning.

Additionally, U.S. Pat. No. 6,002,124 of Bohn, et al., for "Portable Image Scanner With Optical Position Sensor" discloses an imaging device which may be comprise of an image head having an elongate slot therein with first and second lengthwise ends. The image head may also include a first navigation sensor aperture and a second navigation sensor aperture positioned adjacent the elongate slot at positions other than positions that are aligned with the first and second lengthwise ends of the elongate slot. An image sensing system optically aligned with the elongate slot in the image head is responsive to image light passing through the elongate slot and produces an image signal based on the image light. A first navigation sensor optically aligned with the first navigation sensor aperture in the image head is responsive to first navigation light passing through the first navigation sensor aperture and produces a first navigation data signal based on the first navigation light. A second navigation sensor optically aligned with the second navigation sensor aperture in the image head is responsive to second navigation light passing through the second navigation sensor aperture and produces a second navigation data signal based on the second navigation light. U.S. Pat. No. 6,005,681 of Pollard for "Image Scanning Device and Method" describes a method of reconstructing an image from scanned parts of an original image obtained by relative movement between a scanning device and the original image so that adjacent scanned image swaths overlap. The scanning device comprises navigation means for determining the position of the scanning device relative to the original image. Navigation corrections are calculated by correlating features within the area of overlap between adjacent swaths.

Also related is U.S. Pat. No. 5,552,597 of McConica for "Hand-held Scanner Having Adjustable Light Pad" discloses a lens assembly which is positioned between an illuminated scanning area and a detector. Positioned between the lens assembly and the illuminated scanning area is a multiple reflecting assembly which defines a folded light path between the lens assembly and the illuminated scanning area. A prismic reflecting assembly is movably mounted between the lens assembly and the multiple reflecting assembly, so that the length and direction of the folded light path can be changed by moving the prismic reflecting assembly to align and focus the image of the illuminated scanning area on the surface of the detector. U.S. Pat. No. 5,586,212 of McConica, et.al., for "Optical Wave Guide for Hand-held Scanner" describes first and second elongate curved reflecting surfaces which are positioned in non-parallel, spaced apart relation, which collect light from an elongate light source and direct the light onto a scanning area. One edge of the first curved reflecting surface is positioned adjacent the light source and the opposite edge is positioned adjacent the illuminated scan area so that the first curved reflecting surface extends from about the light source to about the illuminated scan area. The second curved reflecting surface is positioned in opposed spaced-apart non-parallel relation to the first curved reflecting surface such that the distance separating the reflecting surfaces at the light source is less than the distance separating the reflecting surfaces at the end adjacent the illuminated scanning area. An elongate planar reflecting surface is positioned adjacent the second curved reflecting surface so that it is substantially perpendicular to the illuminated scan area. Some of the light rays from the light source are reflected by the first curved reflecting surface and the second curved reflecting surface onto the planar reflecting surface, which in turn reflects the light rays onto the illuminated scan area so that they are incident on the illuminated scan area at substantially oblique angles. Other light rays from the light source are directly reflected by either the first curved reflecting surface, the second curved reflecting surface, or by a combination of the two, onto the illuminated scan area so that they are also incident on the illuminated scan area at substantially oblique angles.

Each of the above described patents are assigned to the assignee of the present application and are hereby incorporated in their entirety by reference for all that they disclose.

Similarly, portable computer printers are well known in the prior art and include dot matrix printers, piezo-electric inkjet printers, laser printers and thermal inkjet printers. Additionally, scanner/printer combinations are known in the prior art as are combination machines which include scanner features, printer features, facsimile machines, and document copying capabilities. However, the scanners used in these combinations are relatively large desktop units serving to optically scan sheet documents transported through or placed on a scan window of the device.

A need exists for a portable printer that is adaptable to print in combination with a portable device on a desktop unit. A further need exists for a compact printer compatible with a handheld device such as a personal digital assistant (PDA).

SUMMARY OF THE INVENTION

The present invention describes a system and method of printing an image onto a page with a handheld printer. A page is defined to be the print receiving media or object as including paper sheets, cartons, printable object or media or any other surface capable of receiving an ink, dye, or other material to be applied to a surface. The method comprises the steps of moving a handheld printhead over the surface of a page; locating a position of the printhead relative to the page; and printing a corresponding portion of the image onto a corresponding portion of a print receiving page in response to continuously updated determinations of the location of the printer relative to the page and previously printed portions of the image. A manual movement of the handheld printhead is performed using a series of continuous motions. The location of the printhead may be continuously or near continuously determined with respect to a corner or an edge of the page and/or may use the inherent structural features of the page to detect direction and degree of movement. The determination of the handheld printhead's position may also use visible or microscopic servo marks formed on the page. The image printed on the page may be stored in a memory of the handheld printer in a bit-mapped representation, printable format, or other acceptable format. The image may also be optically scanned into the handheld printhead in a digital representation of the image. If the image is scanned into the handheld printhead, the scanning may include reading a first swath of the image; reading a second swath of the image; and stitching the first swath with the second swath to produce the image.

According to another embodiment of the invention, a handheld device includes a printhead for printing a facsimile of an image onto a page. The device includes a navigation sensor which determines a position of the printhead relative to the page. A controller correlates the image information with the navigation information from the navigation sensor so that the printhead responds to the image information to print a facsimile of the image onto the surface of the page. The navigation sensor may determine the position of the handheld device from the inherent structural features (e.g., fibers contained in a paper, etc.) and/or with respect to an edge or a corner of the page and/or may use servo marks to calculate its position. The handheld device may also use printed information on the page to determine its position. A memory stores the image data. An optical scanner may be included to capture a representation of the image from an image source such as a printed media.

According to another embodiment of the invention, a handheld device includes an image detector used to scan an image and a printhead for printing a facsimile of the image onto a page. The handheld device includes at least one navigation sensor used to determine a position of the handheld device relative to the surface of the page to provide navigation information. A scanner is used to scan the image from an image source to provide image information. A controller is configured to correlate the navigation information with the image information. A printhead is then included to transfer a facsimile of the image onto the surface of the page. The handheld device may include a memory which stores and maintains links between the navigation information and the image information. The navigation sensor may determine the position of the handheld device from and relative to an edge of the surface of the page, from information printed on the surface of the page, or from a combination of these reference points and methods. The scanner included in the handheld device may provide the image information in elongated, substantially rectangular "swaths" that are stitched together to form a complete image. The printhead of the handheld device may also write servo marks on the surface of the page to help keep track of its motion over featureless portions of the media (e.g. blank portions of page).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, reference is now made to the following descriptions taken in conjunction with the accompanying drawing, in which.

DETAILED DESCRIPTION

Figure 1:
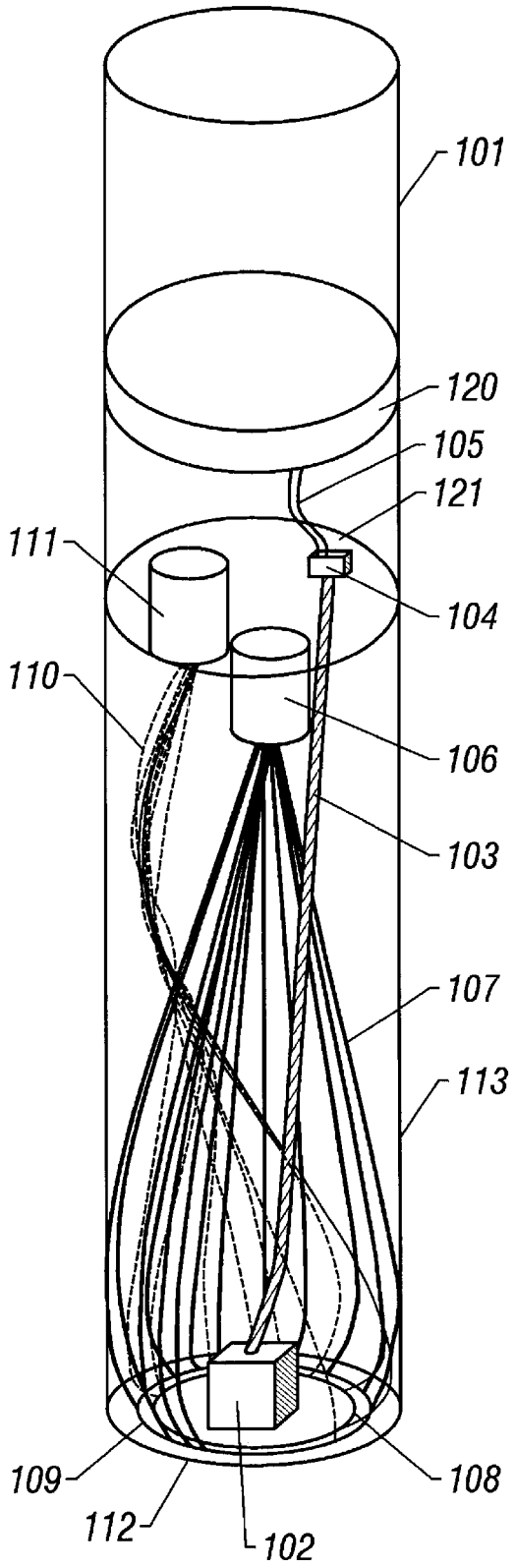
FIG. 1 is a perspective view of a pen-like embodiment of a handheld printer.

FIG. 1 is a perspective view of one embodiment of a handheld printer in the form of an elongated writing stylus or "pen-like" device 101. Pen-like handheld printer 101 includes printhead 102, connected by cable 103, and connector 104 to circuit board 105. Printhead 102 is used to print the images onto a print receiving media such as paper, film, or any other surface capable of receiving an ink or dye (hereinafter page) applied by printhead 102. Cable 103 and connector 104 are used to pass print commands from circuit board 105 to printhead 102. These commands are in the form of conventional printhead driver signals appropriate to the type, make and model of printhead employed. Typically, these commands would come from an external service, such as a computer, personal digital assistant, facsimile machine, etc. These commands could also come from the user by way of pressure points activated, voice commands, or by optical impulses.

In addition to the device components which are required for the printing function, printing device 101 also includes components to ascertain its location on the page. Light source 106 transmits light through light pipes or fiber optical strands 107. Detector pickups 108 examine features of the page while light pipes 109 illuminate the page. Fiber optic strands 110 transmit images to CCD array 111 (or similar device). In order for pen-like printing device 101 to determine its position on the printable surface, light source 106 illuminates the surface of the printable object or media. The illumination from light source 106 is transmitted, for example, through fiber optical strands 107 to illuminate the printable surface. The fiber strands are terminated at an angle of between 5 and 45 degrees and more preferably, at an angle of between 15 and 30 degrees relative to the print receiving media when printing device 101 is operationally positioned relative to the media. Illuminating the surface of the media at an angle enhances surface details which may be used to determine movement across the surface. Although FIG. 1 shows a bottom end 112 of tube 113 oriented at right angles relative to the tube walls, bottom end 112 may be canted to accommodate a user holding tube 113 at a slight angle (e.g. approximately 30 degrees) relative to the media as a conventional writing instrument, such as a pen or pencil, might be grasped and held when writing.

Once the printable surface is illuminated, features of the printed surface may be captured to allow device 101 to determine its position on the printable surface. In FIG. 1, an inner ring of optical detectors are used to identify features on the printable surface, such as lines, previously printed text, or similar features on the surface of the page. Light pipes 109 transmit light from light source 106 to illuminate the surface of the media and reveal the structure of the page itself. For instance, if the printable media is paper, light pipes 109 illuminate the surface so that detector 108 may detect the microstructure of the paper itself to identify the location of printing device 101 on the page. Images detected by detector 108 are transmitted via fiber optic strands 110 to CCD array 111. One of ordinary skill in the art would understand that a CCD array or an equivalent optical detector may be used.

Figure 2:
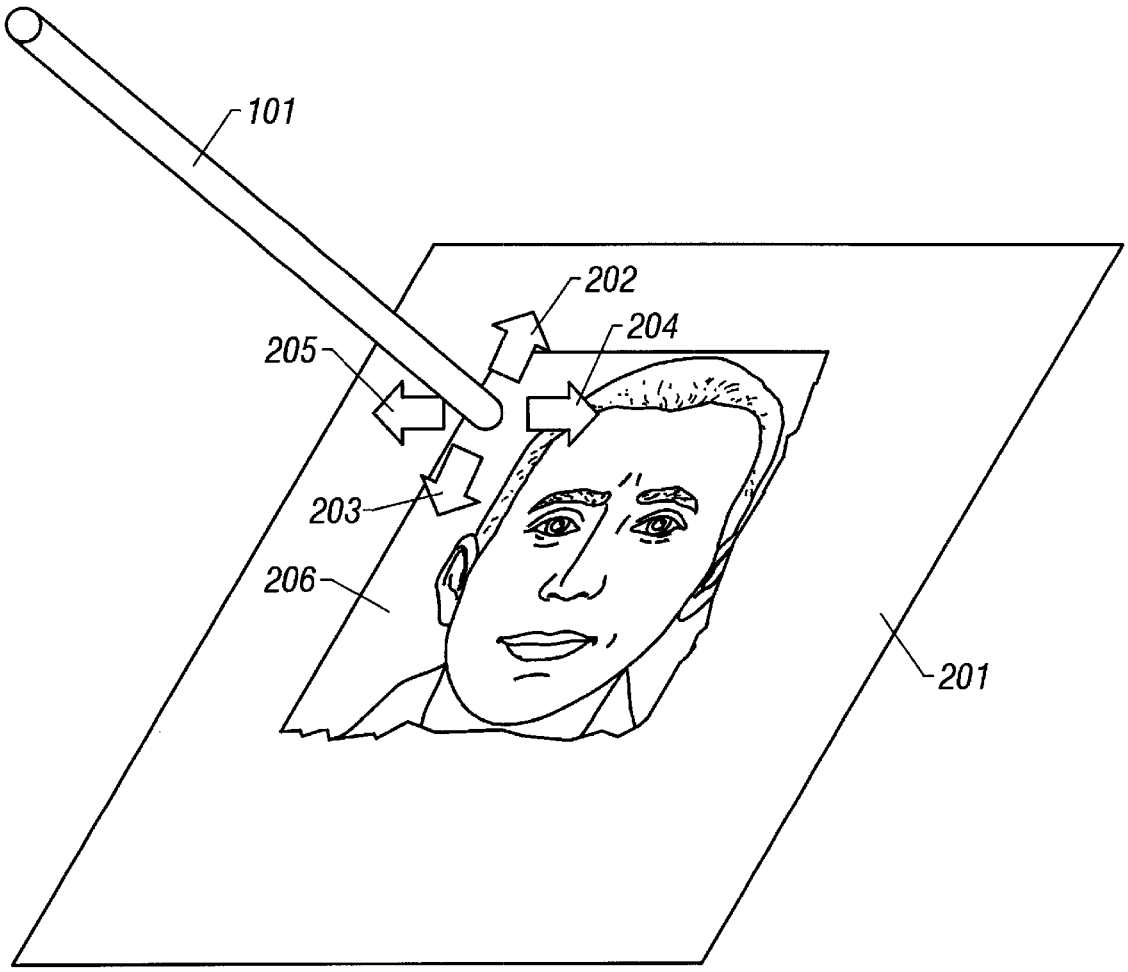
FIG. 2 is a perspective view of a "pen-like" embodiment handheld printer of FIG. 1 being used to print an image onto a paper medium.

FIG. 2 is a perspective view of printing device 101 in use. The user (not shown) moves printing device 101 across the page and printhead 102 (FIG. 1) is properly positioned to transfer an image onto the media. Printhead 102 may be a linear or, more preferably, a square array or circular configuration of ink jets. The image may be stored in pen-like printing device 101's memory 120 and passed to connector 104 via cable 121. The user (not shown) moves printing device 101 towards top 202 of media 201 to print portions of the image closer to the top of the page. Similarly, printing device 101 can be moved down 203, left 205 or right 204 to print portions of the image in those directions. Once the user (not shown) has manipulated printing device 101 over page 201 for a period of time, a partial image 206 will appear. Typically the user will move printer 101 in a raster fashion, left and right, top to bottom, across the surface of the page, much as "coloring in" an image so that all portions of the page are covered by the process. Printer 101 detects surface features such as previously printed matter, media grain structure, etc., to track direction and speed of motion across the page, causing printhead 102 to transfer images appropriate to the present calculated portion onto the page. Printer 101 tracks position and compares it to the bit mapped image stored in memory to check that the image has been properly printed and, if necessary, print missing portions of the image. The printer may include a visual or audio indicator activated upon completion of printing or some predetermined portion of the image (e.g., 99.5%, etc.). Indicators may further be included to direct the user to move the printer to an incomplete portion of the image so that a portion can be "filled in" or completed.

Figure 3:
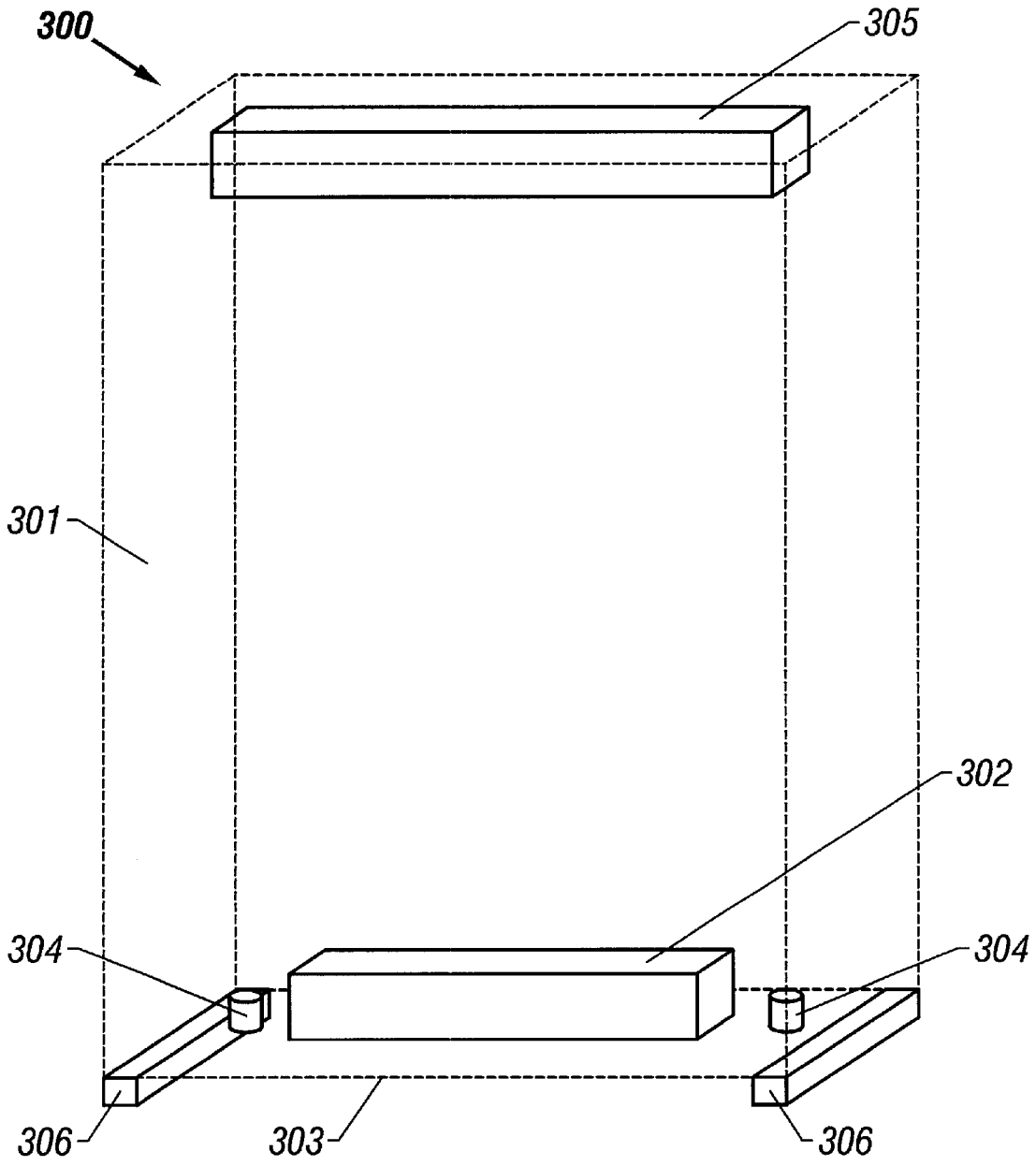
FIG. 3 is a perspective view of a handheld printing device having a linear arrayed printhead.

FIG. 3 is an alternate embodiment in which handheld printing device 300 prints a column wide "swath" down or across a page is described. This configuration is similar to, and may include, a handheld scanner device as previously described. Thus, printer 300 is enclosed in a substantially rectangular enclosure 301 rather than the pen-like housing of printing device 101 previously depicted. The enclosure 301 includes one or more rows of printheads 302 which are included in a rectangular lower surface 303 which is passed over the page. Printheads 302 are connected via a cable (not shown) to a circuit board (not shown). One or more optical position sensors 304 are included in enclosure 301 to optically detect position and motion across the page to identify where the rectangular handheld printing device is orientated with respect to the page and image area. These optical positioning sensors may be mounted on lower surface 303 or remotely mounted, connected by a suitable light pipe or fiber optic bundle to a CCD scanning array 305. CCD array 305 may be used to scan material for input to image memory and, when operated in the print mode, used to detect printer location on the page. Alternatively, CCD array 305 may be located in lower surface 303 adjacent or surrounding printhead 302. Additionally, skids or spacers 306 may be included to ensure the handheld printing device 300 is held by the user (not shown) a suitable distance from the printable media. Additional optical position sensors may be included on rectangular surface 303 to better ascertain the rectangular handheld printing device's position and orientation relative to the page.

Figure 4:
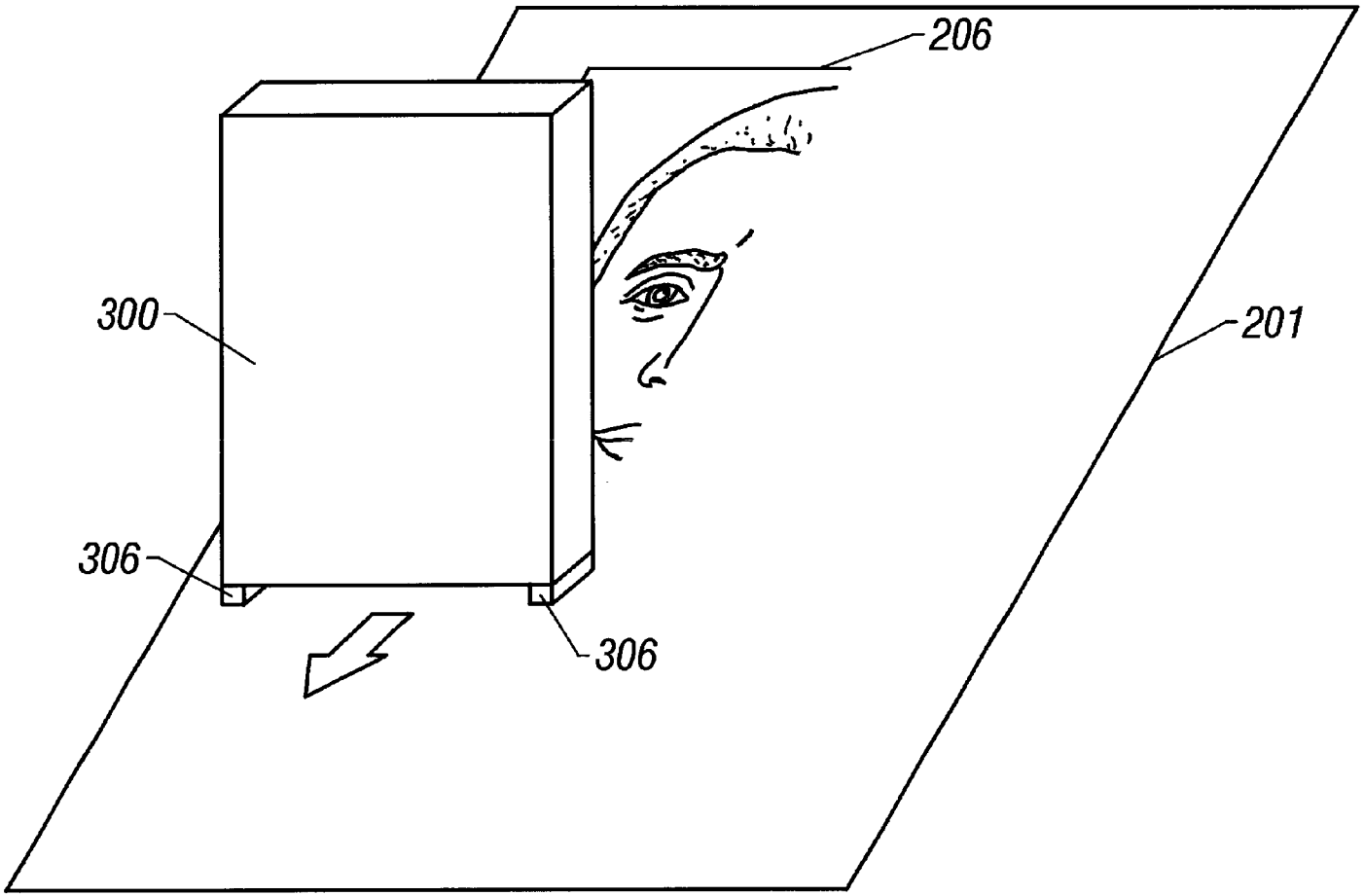
FIG. 4 is a perspective view of the handheld printing device of FIG. 3 printing a rectangular swath onto a portion of a paper sheet.

FIG. 4 is a perspective view of printing device 300 which has printed a partial image 206 onto a page. As previously described, skids or spacers 306 insure that the printing device is held at a suitable distance from printable media 201 to provide proper operation of printhead 302 (FIG. 3).

Ideally, handheld printing device 300 would be positioned at a known location (i.e., a corner) and the user (not shown) would maneuver the handheld printing device in a linear direction over the page. Subsequently the user would pass the handheld printing device over a second portion of the page adjacent to the originally printed section. In order to ensure that handheld printing device 300 accurately determines its position, at least one of the navigation sensors of the handheld printing device should pass over previously printed material. This procedure is replicated until the image is completed or substantially completed. The handheld printing device can also be configured to indicate to the user the position, on the page, which requires additionally printing or, even an indication concerning the remaining material left to be printed on the page. Additionally, an indication can be given to the user if the handheld printing device is being moved too rapidly across the surface of the page.

As described in the referenced patents, handheld scanners may scan portions of a scanned image and, once the entire image is scanned, may stitch together these scanned portions of the image to form the entire image. While this technique worked for virtual images stored in a memory, stitching is not available for printing. Ideally, the present invention of a handheld printer cannot print the image until the handheld printer has an estimate or has accurately determined where on the page the handheld printer is located. Once the handheld printer has accurately estimated or precisely determined its position on the page, the appropriate portion of the image may be printed by the handheld printer.

Figure 5:
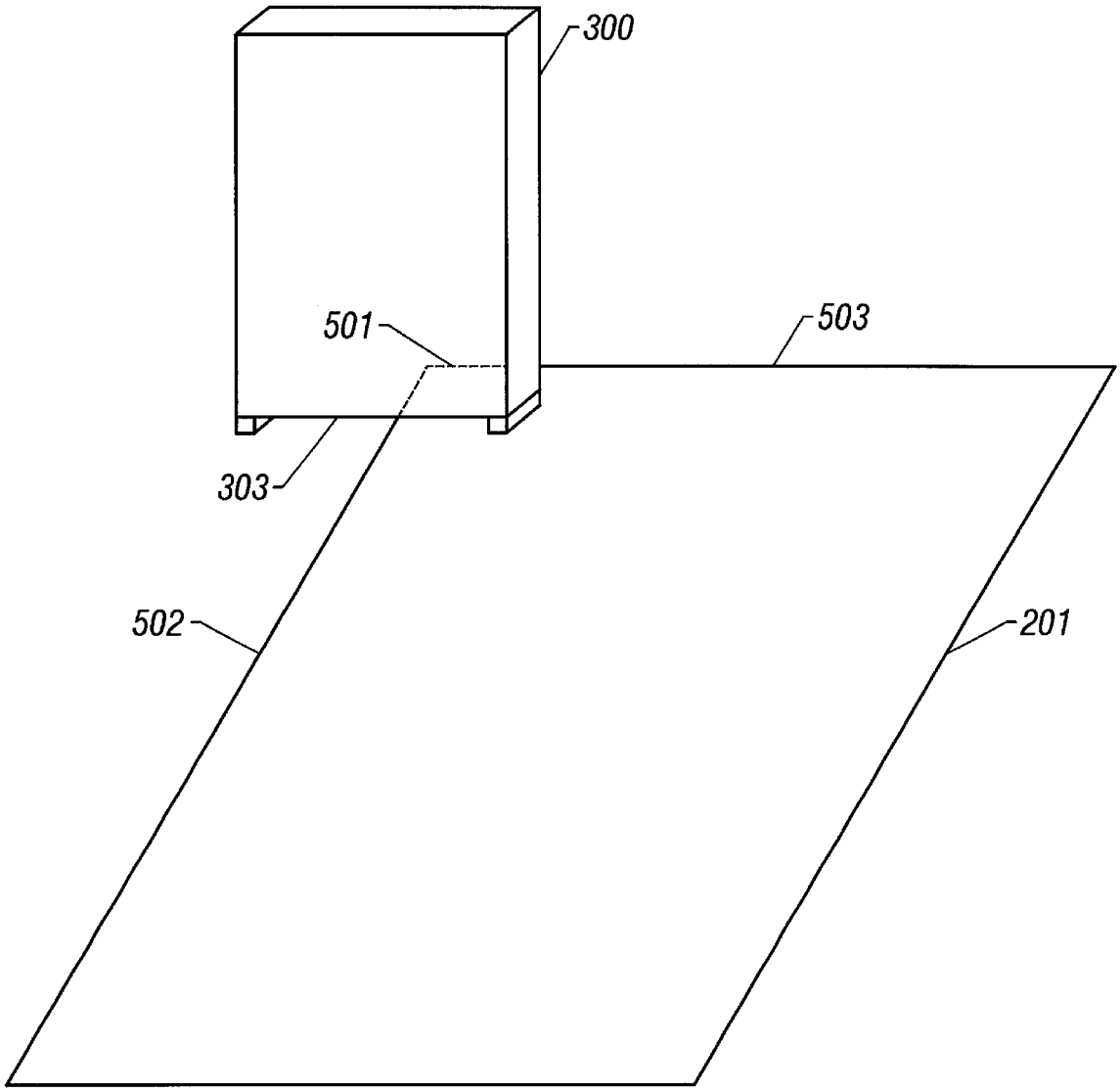
FIG. 5 is a diagram depicting the orientation of the handheld printing device of FIG. 3 on a sheet of paper so as to detect a starting reference point.

FIG. 5 is a perspective view of printer 300 depicting one method in which the handheld printer is positioned at a reference portion such as a corner of sheet 201. The user may begin the printing operation of rectangular handheld printer 300 by positioning rectangular handheld printer 300 above upper lefthand corner 501 of page 201 so that printer 300 can locate this reference position and relate it to image memory. In this position the navigation sensors of rectangular face 303 of printer 300 straddles two edges (502 and 503) of page 201. As printer 300 is maneuvered away from upper lefthand corner 501 of page 201, it tracks its position with respect to upper lefthand corner 501 of page 201. Since printer 300 can calculate its position with respect to page 201, printer 300 may determine the correct image portion to be printed at the present location. Printer 300 may also track its position with respect to page 201 by the microscopic features in page 201. In order to accurately track the microscopic features of page 201, a light source is required to illuminate such microscopic features at a grazing angle. This is accomplished by the angled orientation of the light pipes relative to the surface 109 as depicted in FIG. 1 and further explained in the incorporated referenced patents. These light pipes at an angle to the surface 109 may be eliminated, or the resulting positional accuracy may be enhanced, through the incorporation of other position determining procedures in the printer. For example, a roller or "track ball" as used in a mouse may be included and arranged to engage and roll along a surface of the sheet. Alternatively, a frame may be used, edges of the frame engaging sensors on the printer to determine position with the frame, etc.

Printing device 300 may use portions of images it has already printed on page 201 to track and determine its position with respect to page 201. Alternatively, or in addition, printer 300 may write servo marks on page 201 to keep track of position with respect to page 201, particularly in non-printing or otherwise blank portions of the sheet. These servo marks may be used by printer 300 to determine its position with respect to upper lefthand corner 501 of page 201 or any other portion thereof that allows for an accurate determination of the position of printer 300. The printing of these detectable servo marks by printer 300 ensures that the optical positioning sensors 304 (FIG. 3) can compute position even in the absence of other printed matter. The size of these servo marks may be sufficiently small as to be virtually undetectable by the naked eye and/or the servo marks may be printed in an ink that appears only under special illumination such as ultraviolet light. In the latter case, an ultraviolet light can be incorporated within printer 300 to allow the servo marks to be read. Ultraviolet visible ink is then used to print the servo marks. The servo marks written by the printer allow it to determine its position with respect to page 201. This may be accomplished by the servo marks indicating a direction and a distance from a known point on page 201, or by the inclusion of servo marks which map page 201 so that rectangular handheld printer 300 determines its position with respect to page 201 when any servo mark is read by rectangular handheld scanner 300.

Figure 6:
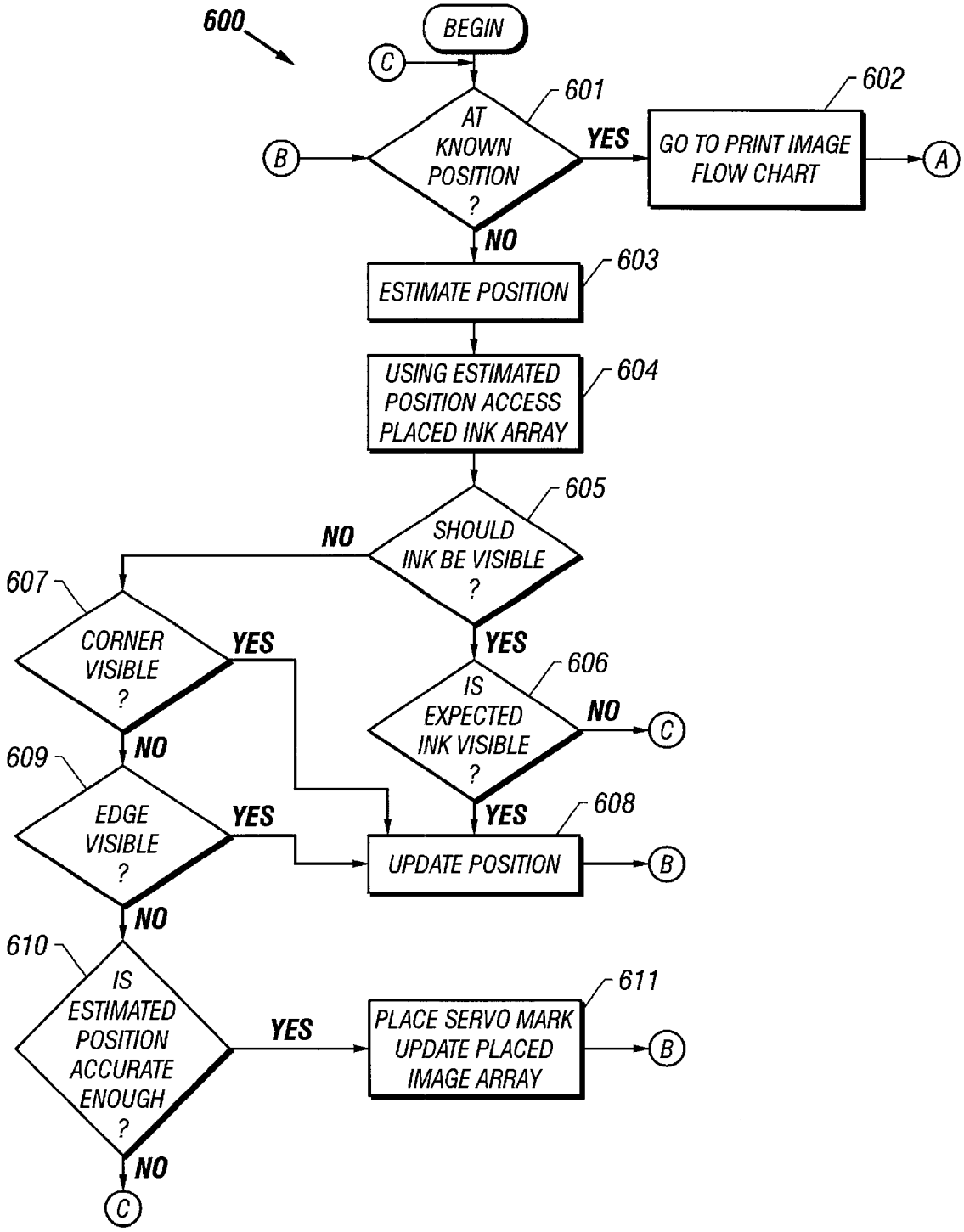
FIG. 6 is a flow diagram of a process for determining the position of the handheld printing device.
Figure 7:
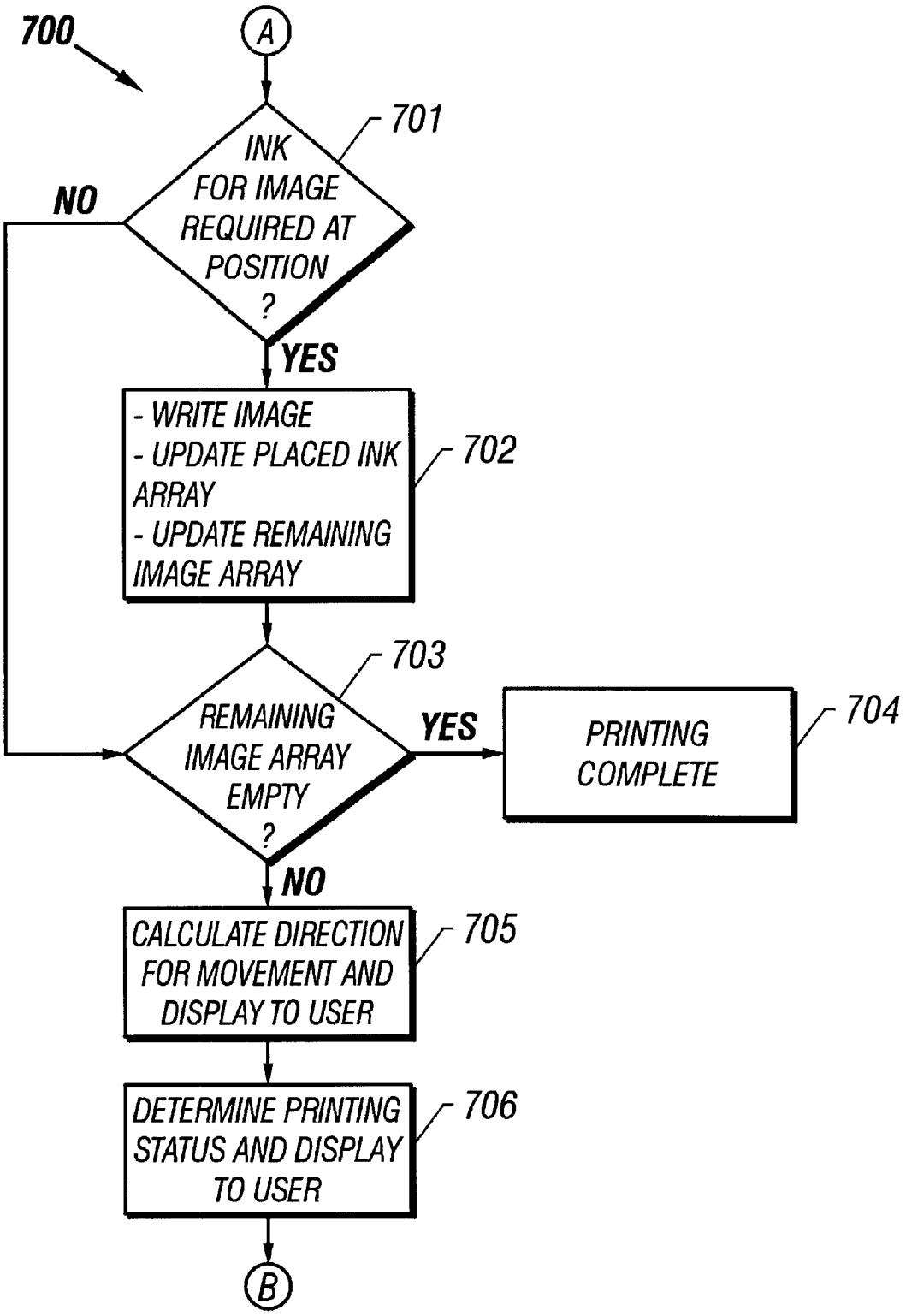
FIG. 7 is a flow diagram of a process for printing an image onto a media using the handheld printing device according to one aspect of the invention.

FIG. 6 is a flow chart of a method 600 used by a handheld printer to determine its position on page 201. At Step 601 a determination is made as to whether the handheld printer is at a known position. The handheld printer may be at a known position if it is positioned over upper lefthand corner 501 of printable media 201 or if it can accurately calculate its current position from available information. An accurate estimate may be treated as a determined position if the accuracy is acceptable to the user. If the position of the printer is known, Step 602 is executed, execution transferring to print the corresponding image according to flow chart 700 (FIG. 7). If the position of the printer is not known at Step 601, the position of the handheld printer is estimated in Step 603. This estimated position in Step 603 may be determined from tracking its movement since its last known position, from calculations based on velocity and time or any other accurate positioning means. Step 603 may also include determining position through sensors which measure the movement of the handheld printer from a previously known position.

Once the estimated position of Step 603 is calculated, the printer uses the estimated position to access memory indicating previously printed matter at Step 604 to determine if printing should be visible by the printer at the estimated position. In one embodiment of the present invention, three arrays are used by the handheld printer: an image array, a remaining image array, and a placed ink array. These arrays relate positioning information with portions of the image. Initially the entire image is placed in the image array. Prior to initialization of printing, the image stored in image array is copied to the remaining image array. As the handheld printer prints the image, printed portions of the image are removed from the remaining image array and placed in the placed ink array. As more of the image is printed, the portion of the image stored in the remaining image array is reduced as the portion of the image stored in the placed ink array increases. When the remaining image array is empty, the entire image has been printed and the place ink array contains at least the image array. The placed ink array may also contain servo marks for navigation accuracy. While, for purposes of explanation, three distinct arrays are described, alternate data structures may be used such as a single image array with associated flags or sensitized values indicating whether particular pixels have been printed or are awaiting printing.

In Step 605, the printer determines whether previous printing should be visible in its current estimated position. Visibility of servo marks previously left by the handheld printer is also checked in Step 605. If previous printing (including servo marks) should be visible at the current location, a determination is made at Step 606 whether the expected ink is actually visible. Step 606 looks for the presence of the expected ink and not just the presence of ink. For instance, if the word "the" should be visible to the handheld printer in its current location, any other printed image will not trigger a yes response in Step 606. If the expected ink is visible to the handheld printer in Step 606, the position may still need to be updated to compensate for small registration errors which normally appear.

If, at Step 605, ink should not be visible to the handheld printer and the position is not known, a series of steps are executed to help accurately ascertain the handheld printer's position. At Step 607 a determination is made as to whether a corner of the printed media 201 is visible to the handheld printer. If a corner of the printable media 201 is visible to the handheld printer the position is updated in Step 608 to reflect the current position of the handheld printer so that the present position of the printer is known. If a determination is made that a corner is not visible to the printer, the printer determines if an edge of printable media 201 is visible in its current location in Step 609. If an edge is also not visible to the handheld printer in Step 609 in its current location, a check is made at Step 610 to determine whether the estimated position of the handheld printer is sufficiently accurate for a servo mark to be placed at the current location. The required accuracy may be determined or predefined and may be sufficient if within several pixels. If an affirmative answer is obtained in Step 610, then a servo mark is placed at the current location in Step 611. If, however, in Step 610 the estimated position is not accurate enough for a servo mark to be placed, flow 600 is restarted in Step 601 to determine if the handheld printer has been moved enough that its position can now be determined. If the handheld printer has not been moved, a signal can be given to the user indicating such.

FIG. 7 is a flow diagram of a process 700 used to determine whether the printer should print at its current location. In Step 701, the handheld printer's current location is compared to the information contained in the remaining image array to determine if ink is required at the printer's current location. If ink is to be applied at the current location at Step 702, that portion of the image retrieved from the remaining image array is placed at the current location, the placed ink array is updated to reflect the information printed and the updated remaining image array is also updated to delete (or otherwise indicate as having been printed) the portion of the image that has just been printed by the handheld printer. These three actions all occur at Step 702. Once the remaining image array is updated at Step 702 a determination is made as to whether the entire image has been printed. This determination is made by examining the remaining image array. If the remaining image array is empty (or is substantially empty), the entire image has been printed and Step 704 is encountered and printing is completed.

Note that the handheld printing device can contain memory and/or a processor (one or both of these functions can be associated in a separate computing device, not shown). Process 700 can be designed so that a check is made to determine 1) if an image (pixel) is to be printed at a specific location, and 2) if that pixel has already been printed. If the answer to 1) is yes and the answer to 2) is no, then ink (or other printing process) is applied at that pixel. If the answer to 1) is yes and the answer to 2) is yes, no ink is applied (unless an over-ride signal is applied by the user). Of course, if the answer to 1) is no, then no ink is applied at that pixel.

If the remaining image array is not empty, additional printing should occur and the handheld printer can determine the direction the handheld device should be moved to continue printing. In Step 705 this direction is calculated and displayed to the user. Additionally, Step 706 can be used to determine and display the print status to the user. Once the handheld printing device has been moved, processing continues at Step 601 and position determination is repeated.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of printing an image onto a surface of a media, the method comprising the steps of:

moving a handheld printhead over the surface of the media;

locating a position of said printhead relative to said media;

printing at least a portion of said image onto a corresponding portion of the surface of the media under control of said locating step; and displaying a direction in which additional printing is possible.

2. The method of claim 1 wherein said step of locating includes relating said position to inherent structural features of the media.

3. The method of claim 1 wherein said step of locating includes relating said position to an edge of said media.

4. The method of claim 1 wherein said step of locating includes relating said position to servo marks printed on the media.

5. The method of claim 4 wherein said servo marks are printed by said handheld printhead.

6. The method of claim 1 wherein said step of locating includes relating said position to information printed on the media.

7. The method of claim 6 wherein said printed information is a portion of said image printed by said handheld printhead.

8. The method of claim 1 further comprising:

storing the image in a memory within said handheld printhead in a bit-mapped representation.

9. The method of claim 1 further comprising:

optically scanning an object with said handheld printhead to capture a digital representation of said image.

10. The method of claim 9 wherein said optically scanning step further comprises the steps of:

reading a first swath of said image;

reading a second swath of said image; and stitching said first swath with said second swath to produce the image.

11. A handheld device for printing a facsimile of an image onto a surface of a media comprising:

at least one navigation sensor for aiding in the determination of a position of the handheld device relative to the media to provide navigation information;

a controller configured to correlate image information with said navigation information;

a printhead associated with said handheld device responsive to said image information to print a representation of the image onto the surface of the media; and a directional indicator configured to display a direction in which additional printing is possible.

12. The handheld device of claim 11 wherein said navigation sensor determines said position from structural features of the surface of the media.

13. The handheld device of claim 11 wherein said navigation sensor detects printed information on the surface of the media deposited by said handheld device to determine the position of the handheld device.

14. The handheld device of claim 11 further comprising:

a memory for storing the image information defining said image within said handheld device.

15. The handheld device of claim 11 further comprising:

an optical scanner for capturing a representation of the image from an image source.

16. A handheld device for printing a representation of an image onto a surface of a media comprising:

means for determining a position of the handheld device relative to the surface of the media and for providing navigation information;

means for correlating said navigation information with said image information;

means on said handheld device for depositing ink to said surface of said media to create said image representation; and means for indicating a direction in which additional printing may be accomplished.

17. The handheld device of claim 16 further comprising:

means associated with said device for storing said navigation information and said image information.

18. The handheld device of claim 16 further including:

means included within said handheld device for scanning an image from an image source to create said image to be represented.

19. The handheld device of claim 16 wherein said determining means includes means for determining an edge of said surface of the media.

20. The handheld device of claim 16 wherein said determining means includes means for locating specific information on said surface of said media.

* * * * *